US007355348B2

(12) United States Patent
Rudolph

(10) Patent No.: US 7,355,348 B2
(45) Date of Patent: Apr. 8, 2008

(54) BALLAST FOR A DISCHARGE LAMP HAVING A CONTINUOUS-OPERATION CONTROL CIRCUIT

(75) Inventor: Bernd Rudolph, Forstern (DE)

(73) Assignee: Patent-Treuhand-Gesellschaft für Elektrische Glühlampen mbH, Munich (DE)

( * ) Notice: Subject to any disclaimer, the term of this patent is extended or adjusted under 35 U.S.C. 154(b) by 307 days.

(21) Appl. No.: 11/135,461

(22) Filed: May 24, 2005

(65) Prior Publication Data

US 2005/0264243 A1 Dec. 1, 2005

(30) Foreign Application Priority Data

May 26, 2004 (DE) ..... 10 2004 025 774

(51) Int. Cl.
*H05B 39/04* (2006.01)

(52) U.S. Cl. ..... 315/107; 315/309

(58) Field of Classification Search ..... 315/32, 315/94, 95, 107, 291, 307, 308, 309
See application file for complete search history.

(56) References Cited

U.S. PATENT DOCUMENTS 3,875,459 A * 4/1975 Remery et al. ..... 315/205
5,471,116 A * 11/1995 Schiller ..... 315/209 R
5,583,399 A * 12/1996 Rudolph ..... 315/291
5,801,491 A * 9/1998 Canova ..... 315/224
6,008,587 A * 12/1999 Mills ..... 315/102
6,448,713 B1 * 9/2002 Farkas et al. ..... 315/291

* cited by examiner

*Primary Examiner*—Thuy Vinh Tran
(74) *Attorney, Agent, or Firm*—Carlo S. Bessone

(57) ABSTRACT

The invention relates to a novel ballast for a discharge lamp, in which a continuous-operation control circuit is brought out of operation when a physical operation, which defines a preheating time, of a preheating timer has as yet not been sufficiently returned if the lamp is intended to be restarted.

12 Claims, 3 Drawing Sheets

BALLAST FOR A DISCHARGE LAMP HAVING A CONTINUOUS-OPERATION CONTROL CIRCUIT

FIELD OF THE INVENTION

The present invention relates to a ballast for discharge lamps, to be precise specifically those discharge lamps which have preheatable electrodes.

BACKGROUND OF THE INVENTION

Such ballasts are known per se. They frequently have half-bridge inverter circuits. However, the invention also relates to other ballasts. In principle, an inverter circuit generates from a rectified AC voltage supply or a DC voltage supply a supply power for the lamp which has a higher frequency than the system frequency. In many cases, a control circuit is provided here for controlling the lamp current or the lamp power during continuous operation of the lamp, and this will be referred to below as the continuous-operation control circuit. This continuous-operation control circuit influences the operating frequency at which the inverter supplies power to the lamp and thereby controls the lamp current or the lamp power. This takes place by bringing the operating frequency closer to or further away from resonant frequencies of lamp resonant circuits containing the lamp.

Before the lamp can be operated, it has to be started by a relatively high voltage. For this purpose too, resonance excitation of the lamp resonant circuit is used in many cases. In the case of discharge lamps having preheatable electrodes, the electrodes are initially preheated for a specific time before the actual starting voltage is applied. The preheating time is in this case determined by a preheating timer, in which, in the most general sense, a physical operation runs which defines a temporal delay, and, once the preheating time has expired, must return in order to be able to run again for subsequently switching the lamp on again. The preheating timer in this case has the function of a switch. The details on the implementation of such a preheating timer and the physical operation are not relevant to the principle of the invention, for which reason the above-mentioned general wording has been selected.

In such cases, starting of the lamp takes place independently of the continuous-operation control circuit once said physical operation has run. For this purpose, in some way the starting voltage must be reached, for example by resonance excitation in the lamp resonant circuit. In this case the influence of the continuous-operation control circuit would have a disruptive effect.

SUMMARY OF THE INVENTION

The invention is based on the technical problem of specifying an improved ballast and an improved operating method for discharge lamps having preheatable electrodes using a continuous-operation control circuit.

It relates to an electronic ballast for at least one discharge lamp having preheatable electrodes, which ballast has a continuous-operation control circuit for controlling the lamp current or the lamp power during continuous operation of the lamp via the operating frequency of the lamp, a preheating timer, which defines a preheating time for the electrodes and is designed to define the preheating time by means of a physical operation which runs with a temporal delay and then to allow this operation to return with a temporal delay, the ballast being designed to start the lamp independently of the continuous-operation control circuit when the physical operation of the preheating timer has run, characterized in that the ballast is also designed to bring the continuous-operation control circuit for continuous operation of the lamp out of operation when the preheating element, once operation of the lamp has been interrupted owing to an as yet incomplete return of its physical operation, cannot define a complete new preheating operation, with the result that the lamp can then be started independently of the continuous-operation control circuit.

The invention is also based on a corresponding operating method.

The inventor has established the starting basis of the invention as being the fact that it is possible for problems to result from the temporal delays of the preheating timer. In general, the physical operations defining the preheating time also return again with a specific temporal delay.

This applies, for example, to the case, which is also preferred here, of a PTC thermistor, which is heated during the preheating time by resistive heat losses, as the preheating timer, the PTC thermistor in this case increasing its electrical resistance value as a result of the increasing temperature. An important mechanism which is preferred here is in this case damping of the lamp resonant circuit, which damping decreases with the increasing PTC thermistor value, and starting as a result of resonance excitation therein. If the PTC thermistor is now heated, it then cools down again only slowly. Even continuous heating of the PTC thermistor during continuous operation of the lamp is also to be expected, since small currents flow through it continuously. The cooling process thus begins only once the lamp has been switched off. In the case of the PTC thermistors used for electronic ballasts, the cooling process typically takes several tens of seconds to several minutes and is thus markedly slower than the typical cooling time of the electrodes of approximately several 100 ms. If the discharge lamp is thus switched on again after a relatively short period of time, the PTC thermistor has not sufficiently cooled down again or, in more general terms, the physical operation of the preheating timer has not returned to a sufficient extent. In such cases, operational faults may occur by the continuous-operation control circuit coming into operation or remaining in operation owing to the apparent expiry of the preheating time. This generally disrupts or prevents restarting of the lamp.

The above description would also apply in the same sense for the case in which the physical operation of the preheating timer returns as soon as during the continuous operation of the lamp, i.e. has returned after a relatively long operation. In this case, situations are nevertheless possible in which the lamp is switched on only briefly, is immediately switched off again and thereupon is switched on again relatively rapidly. For example, this may take place when a lamp, luminaire or illumination system is newly installed and where it is necessary for its operability to be "repeatedly tested". In such cases, the operating personnel generally do not know the background of the failure to restart and consider the lamp or luminaire to be defective.

The invention therefore proposes bringing the continuous-operation control circuit out of operation for the case of a physical operation in the preheating timer which has not returned to a sufficient extent, in order to make it possible to restart independently of the continuous-operation control circuit.

This preferably takes place by the lamp voltage, a potential derived therefrom or another variable correlating therewith being applied to an input of a control amplifier or switching transistor in the continuous-operation control circuit. It may of course also be sufficient to merely use a time component of the continuous-operation control circuit or the correlating variable. Reference is made to the exemplary embodiments.

It has already been established above that a PTC thermistor is a common and in this case preferred preheating timer. However, in principle other preheating timers also come into consideration, in particular switches which can be driven by means of timers, for example RC elements.

For the case of a PTC thermistor, the invention also provides for a threshold value component to preferably be connected in series with the PTC thermistor, for example a so-called TISP or SIDAC, i.e. a threshold value component which does not conduct a current below a specific voltage threshold value. This provides the possibility, which has already been discussed at the outset, of the PTC thermistor, which is generally connected in parallel with the lamp, not conducting a current during continuous operation but only in the preheating and starting phases, during which higher voltages are applied.

It is generally necessary for a lamp current measurement to be provided for the continuous-operation control circuit either because the lamp current itself is controlled or because the lamp power is determined from the lamp current. In this case, the invention proposes different preferred variants. Firstly, the lamp current may be measured in series with a coupling capacitor which connects one of the lamp electrodes to one of the supply branches of the ballast. The term "coupling capacitor" generally refers to capacitors which are connected in series with the lamp or the lamps and which prevent a steady-state direct current through the lamp(s).

In this case, preferably with at least one pair of diodes, a branch is provided in which a measurement is carried out only during one half-cycle, and thus no energy is consumed during the other half-cycle. For this purpose, a current measuring resistor is connected in series with one of the diodes. Reference is made to the exemplary embodiments.

A likewise favorable solution which is, however, slightly more complex involves a measuring transformer. Preference is given in this case in particular to a differential current transformer, with which a correction can be made to the total lamp current by the preheating current or the current flowing through the electrodes and, for example, the PTC thermistor even during continuous operation. Only the current actually flowing through the discharge in the lamp is thus considered to be the lamp current.

A further, preferred refinement of the invention provides a voltage control circuit, which serves the purpose of adjusting the starting voltage of the lamp resonant circuit using the frequency of the half-bridge or another converter in the ballast. This voltage control circuit is advantageous since, when starting using resonance excitation as a result of the required magnification factor of the lamp resonant circuit, a relatively accurate frequency adjustment is required. The control circuit can in this case match the frequency to the resonance response of the lamp resonant circuit and can in this case operate in particular by means of limiting the starting voltage by altering the frequency.

The abovementioned continuous-operation control circuit may be combined with the voltage control circuit to such an extent that both have access to the same control input for controlling the operating frequency of the converter. In this case, provision may preferably be made for the circuit to function as a current or power control circuit (i.e. continuous-operation control circuit) as soon as notable lamp currents flow, i.e. the lamp has been started, and, in the other case, the voltage control "has priority". The abovementioned consideration of the preheating current or PTC thermistor current in the lamp current measurement is of importance here. However, it is also possible for a realistic lamp current measurement to be undertaken without a differential current transformer, for example by the current control being blocked during the preheating phase by a voltage measurement via the PTC thermistor (or else via a measuring resistor in parallel or in series with the PTC thermistor).

In many cases, ballasts are designed to operate a plurality of lamps. If these lamps are connected in series, no significant additions need to be made to the abovementioned designs, as is shown in the corresponding exemplary embodiment. If they are connected in parallel, it is particularly expedient to connect the corresponding lamp voltages or variables correlating therewith to the input of the control amplifier or switching transistor in the continuous-operation control circuit in the form of an exclusive-OR combination.

BRIEF DESCRIPTION OF THE DRAWINGS

The invention will be explained in more detail below with reference to three exemplary embodiments. The individual features disclosed therein may also be essential to the invention in other combinations. The description above and below relates to the apparatus aspect and the method aspect of the invention without this being explicitly mentioned in detail.

DETAILED DESCRIPTION OF THE INVENTION

Figure 1:
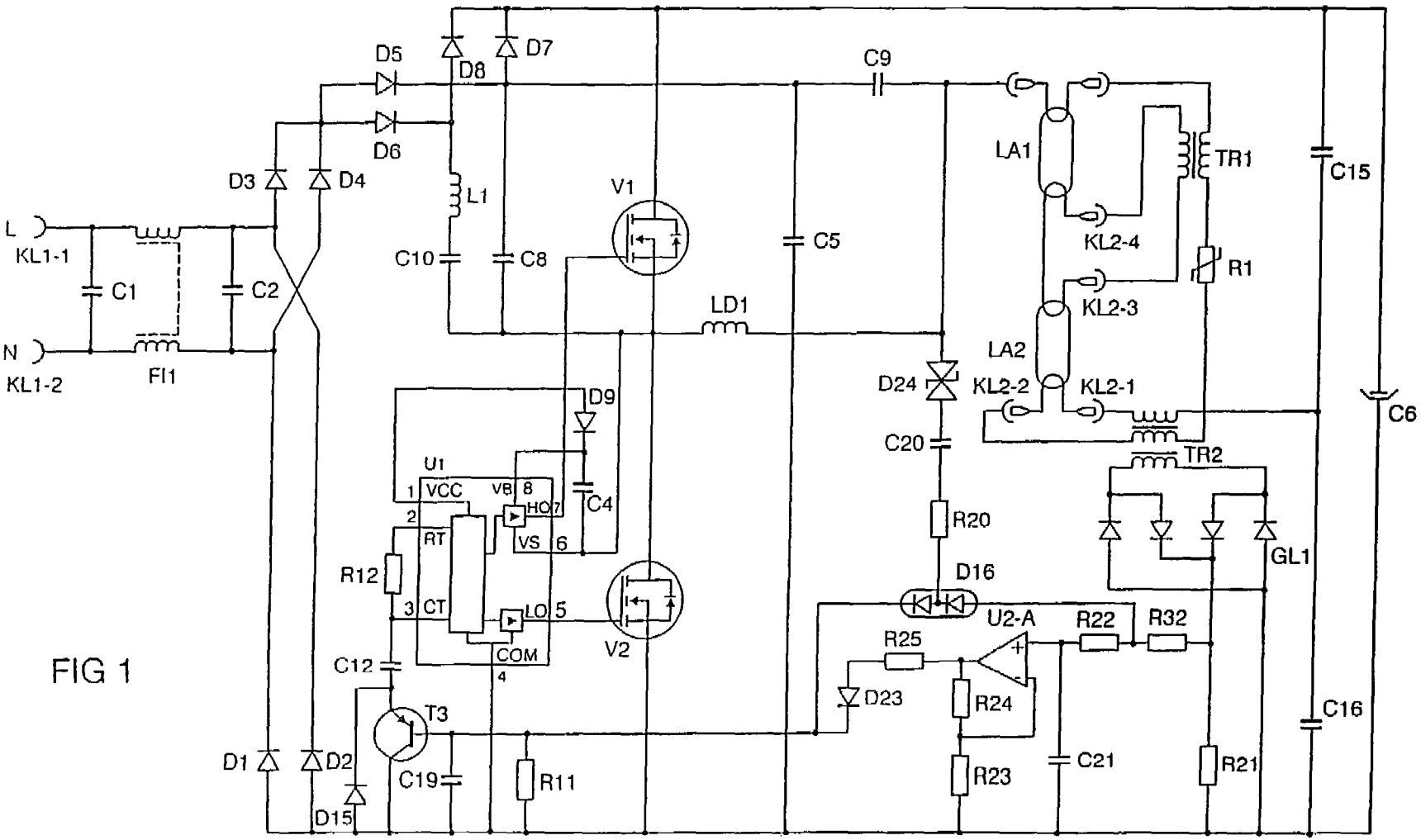
FIG. 1 shows a circuit diagram relating to a first exemplary embodiment according to the invention.

FIG. 1 shows a first exemplary embodiment. Shown on the left are two connections KL1-1 and KL1-2, to which a system voltage can be connected. A filter comprising two capacitors C1 and C2 and two coupled coils, designated FI1, connects the system voltage connections to a full-bridge rectifier comprising the diodes D1-D4. The rectified supply voltage is connected to an intermediate circuit storage capacitor C6, shown on the very right in the figure, via diodes D5-D8 which are to be considered as two pump branches.

In order to adhere to relevant specifications as regards system current harmonics, for example IEC 1000-3-2, so-called pump circuits are also used which involve relatively low complexity in terms of circuitry. In principle, the rectifier is in this case coupled to the main energy store, the intermediate circuit capacitor C6, via an electronic pump switch. The pump nodes lying on the one hand between the diodes D5 and D7 and on the other hand between the diodes D6 and D8 are coupled to the output of an inverter (not described in more detail) via a pump network. As a result, energy is drawn from the system voltage during one half-cycle of the inverter frequency via the pump nodes and is buffer-stored in a pump network. In the subsequent half-cycle, the buffer-stored energy is fed to the intermediate circuit storage capacitor C6 via the electronic pump switch, in this case the diodes D8 and D7. Energy is thus drawn from the system with the timing of the inverter frequency. The mentioned filter elements suppress the corresponding spectral components, with the result that, finally, an almost sinusoidal system current consumption takes place.

Details on the pump circuit are not required for the present invention. Here, reference is made to the prior art and, in particular, to the applications DE 103 03 276.2 and DE 103 03 277.0 by the same applicant.

The intermediate circuit capacitor C6 supplies to the converter which is in this case in the form of a half-bridge comprising two switching transistors V1 and V2. The half-bridge transistors V1 and V2 produce an AC potential by corresponding clocking, in phase opposition, at their central tap, said AC potential oscillating between the two potentials of the rectifier output. This AC potential is connected to the supply branches via a lamp inductor LD1 and, in the present case, a series circuit comprising two discharge lamps LA1 and LA2 and a differential current transformer TR2 (which is explained in more detail below) via two coupling capacitors C15, C16.

FIG. 1 shows the fact that, in this case, not only a current can flow through the discharge plasma in the lamps LA1 and LA2, but also a preheating current can flow through the upper electrode of the upper lamp LA1 and a winding of a heating transformer TR1 and a PTC thermistor R1 and the lower electrode of the lower lamp LA2. The preheating current for the upper electrode of the lower lamp LA2 and the lower electrode of the upper lamp LA1 is generated by means of the heating transformer TR1. It can be seen in FIG. 1 that the differential current transformer TR2 finally determines, in its lowermost winding in FIG. 1, the difference between the total lamp current through the uppermost winding of the differential current transformer TR2 and the preheating current through the central winding. In the case of only a single discharge lamp, the heating transformer TR1 and its circuit through the inner electrodes would be dispensed with.

The preheating current is produced during the preheating phase, inter alia, by the value of the PTC thermistor R1. During the preheating phase, the value of R1 is initially so low that a current is achieved which is predetermined by the lamp data. After the preheating phase, the value of R1 increases such that, finally, a heating current flows which is negligible in comparison with the actual discharge current.

The described arrangement for preheating brings about, during the preheating phase, severe damping of a lamp resonant circuit described below and thus a reduction in the natural frequency markedly below the resonant frequency of the undamped lamp resonant circuit. During the preheating phase, an inverter frequency is used which is below the resonant frequency of the undamped lamp resonant circuit and thus ensures high heating currents and a short preheating phase.

The lamp resonant circuit has, in addition to the abovementioned lamp inductor LD1, resonant capacitors C5 and C9. The resonant frequency is established by an effective capacitance comprising C9 or the series circuit comprising C5 and C9.

If the described lamp resonant circuit is excited after the preheating phase as a result of the damping, which is dropping off owing to the high resistance value of R1, and as a result of the correspondingly increased magnification factor in the vicinity of its resonant frequency, a high starting voltage is produced across the lamps LA1 and LA2, and this starting voltage results in the discharge lamps being started with the aid of the preheated electrodes. Following starting, the lamp resonant circuit acts as a matching network which transforms the output impedance of the inverter to an impedance which is suitable for operation of the discharge lamps.

Overall, the lamp resonant circuit also acts as a pump network. If the potential across the abovementioned pump nodes is lower than the instantaneous system voltage, the pump network draws energy from the system. In the reverse case, the energy consumed is output to the intermediate circuit capacitor C6. A further pumping action originates from the capacitor C8. The capacitor C8 continues to act as a so-called trapezoidal capacitor for relieving the switching load on the half-bridge transistors V1 and V2. The pump network for the second pump branch comprises a series circuit comprising a pump inductor L1 and a pump capacitor C10.

The half-bridge transistors V1 and V2, which are designed as MOSFETs, are driven at their gates by an integrated circuit, for example of the International Rectifier IR2153 type. This control circuit also contains a high-side driver for driving the "high-side" half-bridge transistor V1. In this context, the diode D9 and the capacitor C4 are provided.

In addition to the driver circuits for the half-bridge transistors V1 and V2, the control circuit only contains an oscillator, whose frequency can be adjusted via the connections 2 and 3 (RT and CT). This frequency corresponds to the operating frequency of the half-bridge. A frequency-determining resistor R12 is connected between the connections 2 and 3. A frequency-determining capacitor C12 and, connected in series therewith, the emitter/collector path of a bipolar transistor T3 is connected between the connection 3 and the lower supply branch acting as the reference potential. A diode D15 is connected in parallel with the emitter/collector path in order to be able to charge and discharge C12. The half-bridge frequency can be adjusted using a voltage between the base connection of the bipolar transistor T3 and the reference potential, and a manipulated variable is thus formed for a control loop. The base connection of the bipolar transistor T3 is driven by circuit components which are illustrated further on the right in FIG. 1. The bipolar transistor and the control circuit as well as the associated circuitry thus form a controller.

The functions of the control circuit and the associated circuitry may also be realized by any desired voltage- or current-controlled oscillator circuit, which drives the converter transistors via driver circuits.

In the exemplary embodiment, the controller detects the lamp current as a control variable, to be precise the discharge current. Said discharge current is detected at the lowermost winding of the abovementioned differential current transformer TR2. A full-bridge rectifier GL1 rectifies the current and passes it on, via a low-value measuring resistor R21, to the reference potential. The voltage drop across R21 is passed to the input of a non-inverting measuring amplifier in the form of an operational amplifier U2-A via a low-pass filter comprising the resistors R22 and R32 and the capacitor C21, which is used for averaging purposes. Said measuring amplifier is connected in a known manner by means of the resistors R23-R25 and transmits its output signal via the diode D23 to the above-described controller input (manipulated variable node). The current control loop, which has already been referred to previously as the continuous-operation control circuit, is thus closed. The diode D23 in this case decouples the output of the measuring amplifier U2-A from the voltage divider D24, C20, R20, D16, R11 if the potential across the connection point LD1-D21 is sufficiently high. According to the invention, the circuit arrangement is designed in this case such that, without a discharge current, the potential across the anode of the diode D23 assumes the starting value. Said starting value is below a minimum value which limits the operating range of the transistor T3 and thus the controller. Fluctuations in the potential thus have no influence on the half-bridge frequency as long as the potential remains below the minimum value. The control loop is thus not closed. The starting value brings about a half-bridge frequency which corresponds to the starting frequency. In this case, a relatively low frequency is selected via C12 and R12 which ensures high heating currents and short preheating phases.

Since the starting phase which follows on from the preheating represents a high load for the half-bridge switches V1 and V2 and the lamp resonant circuit LD1, C5, C9, a protective circuit is provided here for preventing starting voltages which are too high. However, this protective circuit at the same time also forms a voltage control circuit for adjusting the starting voltage to a suitable value. For this purpose, a varistor D24 is used at the lamp-side connection of the lamp inductor LD1. Instead of a metal-oxide varistor, it is also possible in this case for a suppressor diode or a zener diode to be used, i.e. a threshold value switch. Beyond a specific threshold value, the lamp voltage is passed between two diodes D16 via a series circuit having a capacitor C20 and a resistor R20. The anode of the left-hand diode represents a second controller input. The value of the resistor R20 influences the level of effect that the intervention, described below, has on the control loop.

The lamp voltage, which is tapped off via the varistor D24, forms a measure of the reactive energy, oscillating in the lamp resonant circuit, and of the starting voltage. If this voltage exceeds the threshold value of the varistor D24, the half-bridge frequency is increased and the reactive energy oscillating in the resonant circuit is thus reduced and, on the other hand, the lamp voltage is reduced.

A typical value for the threshold value of the varistor D24 is, for example, 250 V. The voltage control circuit then controls the voltage such that it is above this voltage.

Following starting, a lamp current flows which lifts the potential across the anode of the diode D23 to a value which is in the operating range of the bipolar transistor T3 and thus closes the control loop of the continuous-operation control circuit (for the lamp current).

On the other hand, in the case of a lamp voltage, which is above the threshold value of the varistor D24, across the right-hand diode D16, which drives a tap between the resistors R22 and R32 at the positive input of the control amplifier U2-A, the potential is lifted at this input. The continuous-operation control circuit can thus be brought out of operation in accordance with the invention if the above-described situation of a new starting attempt occurs without the PTC thermistor R1 having cooled down.

In such a case, only one "abnormal" glow discharge in the discharge lamps LA1 and LA2 would take place owing to the lack of preheating, and in this case relatively high lamp voltages would occur. This abnormal glow discharge, however, produces a notable discharge current, which is measured by means of the differential current transformer TR2 and which brings the continuous-operation control circuit into operation. However, this would now have an influence on the half-bridge frequency and would thus finally disrupt restarting of the lamp by the frequency being moved away from the resonant frequency.

However, applying a (negative) component of the high lamp voltage across the components D24, C20, R20, D16 to the non-inverting input of the control amplifier U2-A causes the continuous-operation control circuit to be blocked such that the above-described voltage control circuit remains in operation. This sets a suitable starting voltage such that the lamp can restart despite failure of the regular preheating operation. Although such a starting operation puts a strain on the electrodes, it does in the end result in the lamp operating. D24 in this case represents a bidirectional zener diode (or suppressor diode or else a varistor) and acts as a threshold value component for decoupling purposes in different operating states.

Figure 2:
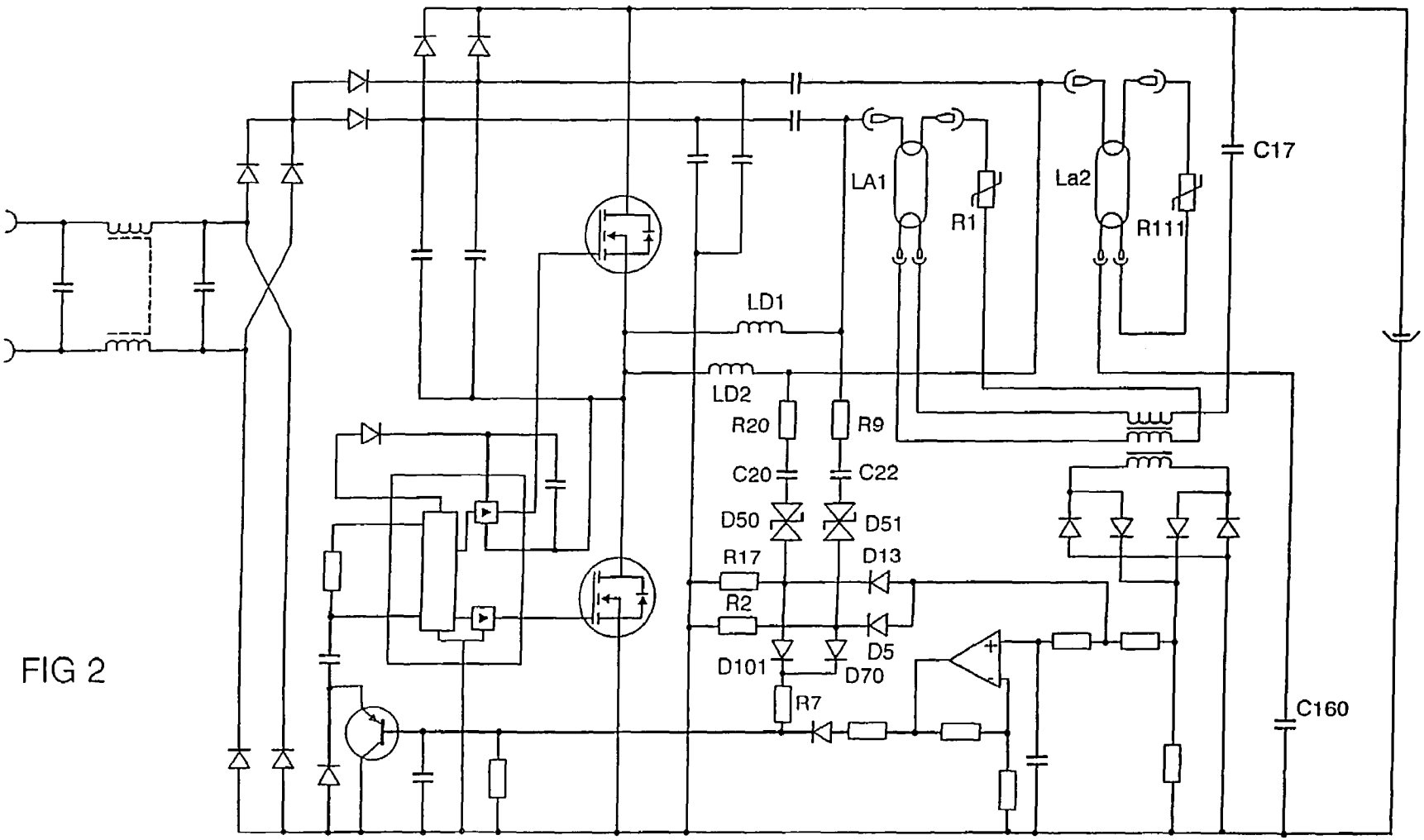
FIG. 2 shows a circuit diagram relating to a second exemplary embodiment according to the invention.

FIG. 2 shows a second exemplary embodiment and differs from the first exemplary embodiment shown in FIG. 1 as described below. For simplification purposes, reference numerals relating to elements already designated in FIG. 1 whose function has not substantially changed are omitted.

As a deviation from the series connection of the two lamps LA1 and LA2 in FIG. 1, in this case the two lamps LA1 and LA2 are connected in parallel load circuits. No preheating transformer is therefore required; rather, direct preheating of the respective lamp electrodes takes place via the PTC thermistor R1 for the lamp LA1 and the PTC thermistor R111 for the lamp LA2.

The differential current transformer TR2, which, however, in this case measures only the lamp current of the lamp LA1 as a deviation from that in FIG. 1, acts as a device for lamp current measurement. During lamp operation, the lamp current of the lamp LA1 thus acts as a control variable, the separate resonant circuit of the lamp LA2 following the frequency controlled for the lamp LA1. However, it would also be conceivable for the controlled lamp current to be formed from components comprising (in this case) both lamp currents.

In this case, the separate voltage divider circuits comprising, on the one hand, C22, R2, R9, D51 and, on the other hand, C20, R17, R20, D50 correspond to the voltage divider circuit comprising D24, C20 and R20 in FIG. 1, the respectively greater potential being dominant via said circuits, to be precise via the diodes D5 and D13 for blocking the continuous-operation control circuit and via the diodes D70 and D101 having the resistor R7 for the voltage control circuit. This is an exclusive-OR combination.

In this case, the coupling capacitors C17 and C160 are used in place of the two symmetrical coupling capacitors C15 and C16 in FIG. 1. In contrast to FIG. 1, here only in each case one coupling capacitor is connected to a lamp connection. However, since there is in this case a parallel circuit comprising two lamps (or more generally a parallel circuit comprising an even number of lamps), even this is a symmetrical solution which as a result does not lead to disadvantageous current loads on the storage capacitor C6 (cf. FIG. 1).

Figure 3:
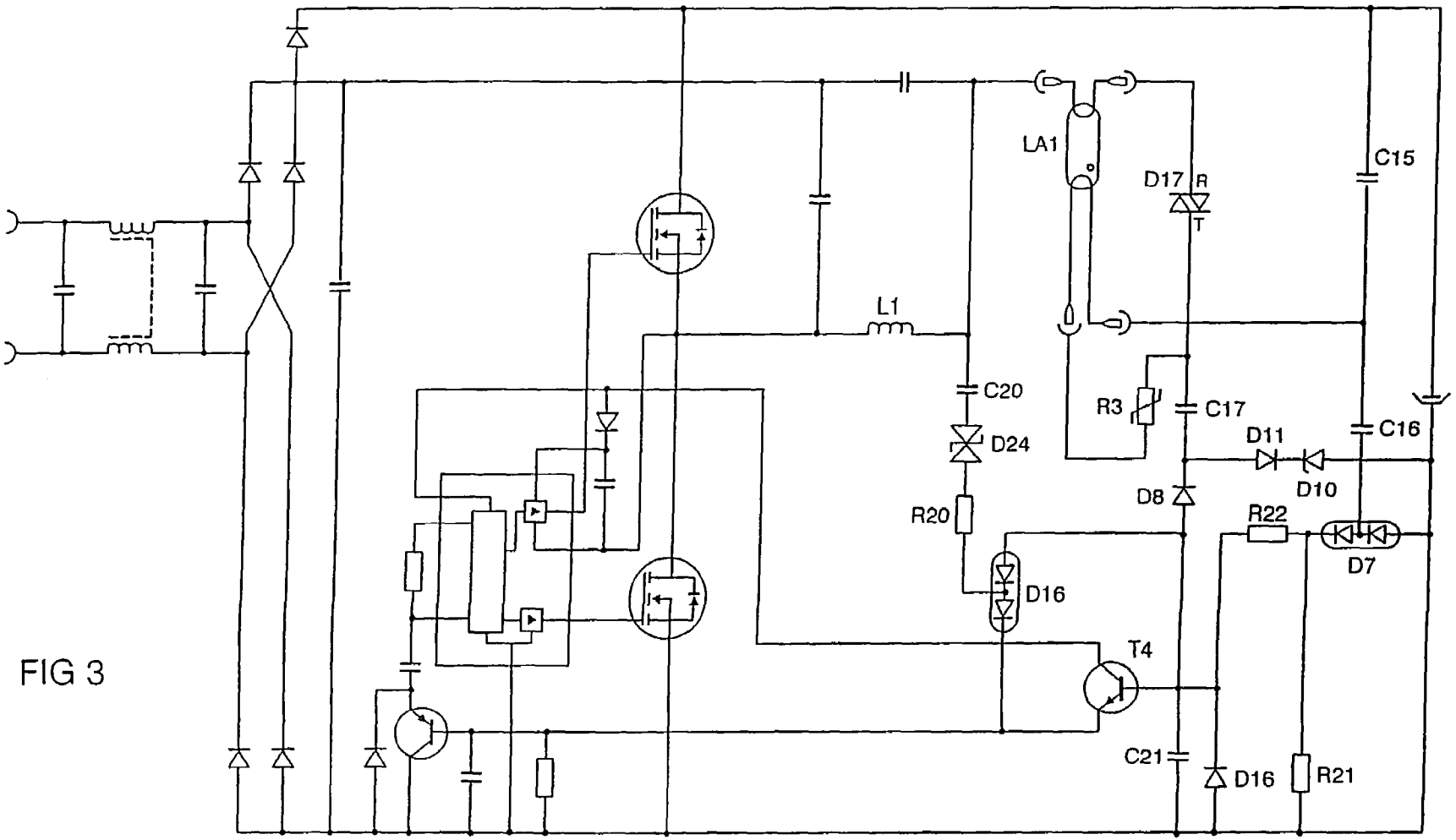
FIG. 3 shows a circuit diagram relating to a third exemplary embodiment according to the invention.

FIG. 3 shows a third exemplary embodiment, which differs from the first exemplary embodiment shown in FIG. 1 as described below. In this case too, the reference numerals have been omitted.

Initially, in this case only one single discharge lamp LA1 is provided, with the result that the heating transformer TR1 in FIG. 1 can be dispensed with.

In addition, there is only one pump branch, for which reason the components D6-D8, C10, L1 are dispensed with. In addition, there is no differential current transformer here. Instead, the lamp current is measured in series with the coupling capacitor C16 via a measuring resistor R21 (to be precise the load circuit current multiplied by the factor C16/(C15+C16)) and passed to the base of a bipolar transistor T4 (impedance converter), which replaces the operational amplifier U2-A, via a resistor R22. This bipolar transistor in this case acts as a control amplifier in the continuous-operation control circuit. The diodes D7 serve the purpose of taking account of only the positive half-cycle during lamp current measurement in order to obtain a suitable potential for the control amplifier.

The lamp electrodes of the single lamp LA1 are in this case preheated directly without a preheating transformer via the TISP/SIDAC D17 and the PTC thermistor R3. In order to suppress the control of the load circuit current flowing when preheating and when starting the lamp LA1, and in order to make it possible to control the voltage via C20, D24, R20, D16, the voltage drop across the PTC thermistor R3, which is high in these modes of operation, is utilized in order to inject a negative current via C17 and D8 and thus to turn the bipolar transistor T4 off.

The RC element R22/C21 forms, in analogy to FIG. 1, the arithmetic mean of the voltage across R21, which is proportional to the lamp current and which is passed on to the VCO input (base T3) via the emitter follower T4. The diode D16 limits the negative voltage at the base of T4 to its forward voltage, and the series circuit D10/D11 dissipates the positive current half-cycle through D17 towards the reference potential (ground) without limiting the positive voltage at the base of T4 during operation of the lamp.

The invention claimed is:

1. An electronic ballast for at least one discharge lamp having preheatable electrodes, said ballast comprising a controller circuit including:

a continuous-operation control circuit for controlling a lamp current or a lamp power during continuous operation of the lamp via an operating frequency of the lamp; and said continuous-operation control circuit including a preheating timer, which defines a preheating time for the electrodes and then resets after a temporal delay;

wherein the controller circuit disables the continuous-operation control circuit when the lamp operation is interrupted and, if the temporal delay has not run out, starts the lamp independently of the preheating timer.

2. The ballast as claimed in claim 1, in which the continuous-operation control circuit is brought out of operation by at least one time component of a lamp voltage or a variable correlating directly therewith being applied to an input of a control amplifier or switching transistor in the continuous-operation control circuit.

3. The ballast as claimed in claim 2, further comprising a plurality of parallel-connected lamps, wherein the time component of the lamp voltage or the variable correlating directly therewith of the parallel-connected lamps is applied by an exclusive-OR combination to the input of the control amplifier or switching transistor.

4. The ballast as claimed in claim 2, in which the preheating timer contains a PTC thermistor.

5. The ballast as claimed in claim 1, in which the preheating timer comprises a PTC thermistor.

6. The ballast as claimed in claim 5, in which a threshold value component, which is not conductive below a specific voltage threshold, is connected in series with the PTC thermistor.

7. The ballast as claimed in claim 1, in which a lamp current measurement for the continuous-operation control circuit takes place in series with a coupling capacitor which connects a lamp electrode to a supply branch.

8. The ballast as claimed in claim 7, in which a diode is provided for the purpose of taking into consideration in each case only one half-cycle of the lamp current during the lamp current measurement.

9. The ballast as claimed in claim 1, in which a lamp current measurement for the continuous-operation control circuit takes place by means of a differential current transformer, the differential current transformer forming, during the measurement, the difference between a total lamp current and an electrode preheating current.

10. The ballast as claimed in claim 1, further comprising a voltage control circuit for adjusting the starting voltage of a lamp resonant circuit by influencing the frequency at which the lamp resonant circuit is supplied.

11. A method for operating a discharge lamp having preheatable electrodes, in which a preheating period of time is defined using a preheating timer which runs, and resets after a temporal delay, preheating the electrodes during the preheating period of time, starting the lamp when the preheating period of time of the preheating timer has run, and, controlling a lamp current or a lamp power during continuous operation of the lamp via an operating frequency of the lamp using a continuous-operation control circuit, characterized in that, in the method, disabling the continuous-operation control circuit when the lamp operation is interrupted, and if the temporal delay has not run out, then starting the lamp independently of the preheating timer.

12. The method as claimed in claim 11, in which the continuous-operation control circuit controls the lamp current or the lamp power during continuous operation of the lamp via the operating frequency of the lamp and the ballast starts the lamp independently of the continuous-operation control circuit when a physical operation of the preheating timer has run.

* * * * *